United States Patent [19]

Cullen, Jr.

[11] 4,302,125

[45] Nov. 24, 1981

[54] GROUND AREA MARKER, ESPECIALLY FOR A GOLF COURSE

[76] Inventor: Brown Cullen, Jr., 3611 Holston Rd., Louisville, Ky. 40222

[21] Appl. No.: 966,735

[22] Filed: Dec. 5, 1978

[51] Int. Cl.[3] ..... E01F 9/02

[52] U.S. Cl. ..... 404/9; 404/15; 272/3

[58] Field of Search ..... 404/16, 15, 9; 272/3

[56] References Cited

U.S. PATENT DOCUMENTS

| | | | |
|---|---|---|---|
| 1,629,433 | 5/1927 | Bonner | 404/44 X |
| 1,736,830 | 11/1929 | McKee | 404/15 |
| 1,764,073 | 6/1930 | Furey | 404/15 |
| 1,789,525 | 1/1931 | Hoff | 404/15 |
| 1,825,667 | 10/1931 | Johnson | 404/11 |
| 2,037,545 | 4/1936 | Sexton | 404/44 X |
| 2,142,803 | 1/1939 | Robertson | 404/16 |
| 2,287,844 | 6/1942 | Tiberghien | 404/44 X |
| 2,354,857 | 8/1944 | Gits | 404/15 X |
| 3,446,122 | 5/1969 | Raichle | 272/3 |
| 3,920,348 | 11/1975 | Paulos | 404/11 X |
| 4,044,179 | 8/1977 | Haas | 273/29 R X |
| 4,127,346 | 11/1978 | Bouffard | 404/15 |

*Primary Examiner*—Nile C. Byers, Jr.

*Attorney, Agent, or Firm*—Mawhinney & Mawhinney & Connors

[57] ABSTRACT

A marker for ground areas has a hollow cylindrical rigid body with an open end and a closed end, the open end constituting the bottom and the closed end constituting the top when the marker is embedded in the ground. Such rigid body is forced under pressure into the ground by pressing it into the ground until the top wall is substantially level with the ground surface. The top wall is treated to present a prominent indicating surface, and, in the instance of the marker being used for golf courses, the top wall is formed from a resilient, plastic or elastomeric material that would be comparable to the natural ground surface insofar as ball reaction thereto in striking the same is concerned.

6 Claims, 10 Drawing Figures

GROUND AREA MARKER, ESPECIALLY FOR A GOLF COURSE

BACKGROUND OF THE INVENTION (1) Field of the Invention

The present invention generally appertains to improvements in marker constructions for use in ground areas and especially relates to a new and novel marker for lawn areas, such as cemeteries, for highways or roadways and especially for golf courses for yardage markers and for outlining or bounding hazards.

(2) Description of the Prior Art

Markers for use in lawn areas and on highway areas are well known in the prior art. Many types of markers have been provided for lawn-type cemeteries, highway markers, general direction indicators, and for yardage markers on golf courses.

In U.S. Pat. No. 1,825,667, a street marker is disclosed with the marker comprising a cylindrical housing adapted to be embedded in the pavement of the street and within the interior of which an indicating member is vertically movable. Such member is held in a raised position by spring means and is slidably mounted so it can move into the interior of the housing when depressed by the force of the wheel of the vehicle. After such vehicle wheel passes off from the member, the interior spring means will force the member again to its uppermost physical position.

Such concept is also disclosed in U.S. Pat. No. 3,920,348, wherein a member is slidably mounted in a cylindrical housing which is embedded in the ground with such member being urged by spring means to a raised above ground level position.

The formation of surfaces of an elastic nature for playing athletic games, such as tennis or the like, is disclosed in U.S. Pat. Nos. 3,446,122 and 4,044,179.

The prior art, as represented by the foregoing patents, discloses complicated vertically slidable and spring mounted markers, and generally discloses elastic surfaces for use on playgrounds, walking surfaces or the like.

SUMMARY OF THE INVENTION

The present invention relates to a marker of a simple structural nature and which is designed for facile universal use by virtue of such simple structural nature which permits ground placement in a quick and easy fashion.

Generally considered, the present invention in its use as a pavement marker or lawn area marker, such as in a cemetery or the like, comprises a hollow cylindrical body having a closed upper end and an open lower end. In its environmental form for use as a highway marker or lawn area marker of a general nature, the cylindrical body and closed end of the marker are of an integral formation, and preferably, are formed in one piece from sturdy and solid material, such as hard plastic or metal. The upper face or outer surface of the closed upper end or top wall is suitably formed or covered with a reflective surface or painted a color so as to be distinctive in relation to its surroundings, either as a highway marker or general use lawn marker.

In its use on a golf course for marking off hazards or for marking off distances or general directions, the closed upper end of the marker is formed from a resilient rubber, plastic or suitable elastomeric substance that would be comparable to the ground surface insofar as ball reaction thereto in striking the same is concerned so that the ball in striking the surface would not unduly bounce but rather would react in the same fashion as when striking the ground.

Thus, an important object of the present invention is to provide a simple, sturdy and reliable ground area marker that can be employed in many diverse environments to mark off or otherwise visually depict various ground areas.

Another important object of the present invention is to provide a one-piece marker which has a body portion provided with an open and closed end with the open end being inserted into the ground as the body portion is pressed into the ground to position the closed end at ground level and with the closed end having an outer surface formed or decorated to be distinctive from the surrounding ground area.

A further important object of the present invention is to provide a ground area marker for golf courses with the body portion of the marker being insertable into the ground so as to position the upper end of the body portion at ground level and with the upper end being formed from a decorated or otherwise visually distinctive resilient material of a nature to react to a golf ball striking the same as the ground surface reacts.

DESCRIPTION OF THE PREFERRED EMBODIMENTS

Figure 1:
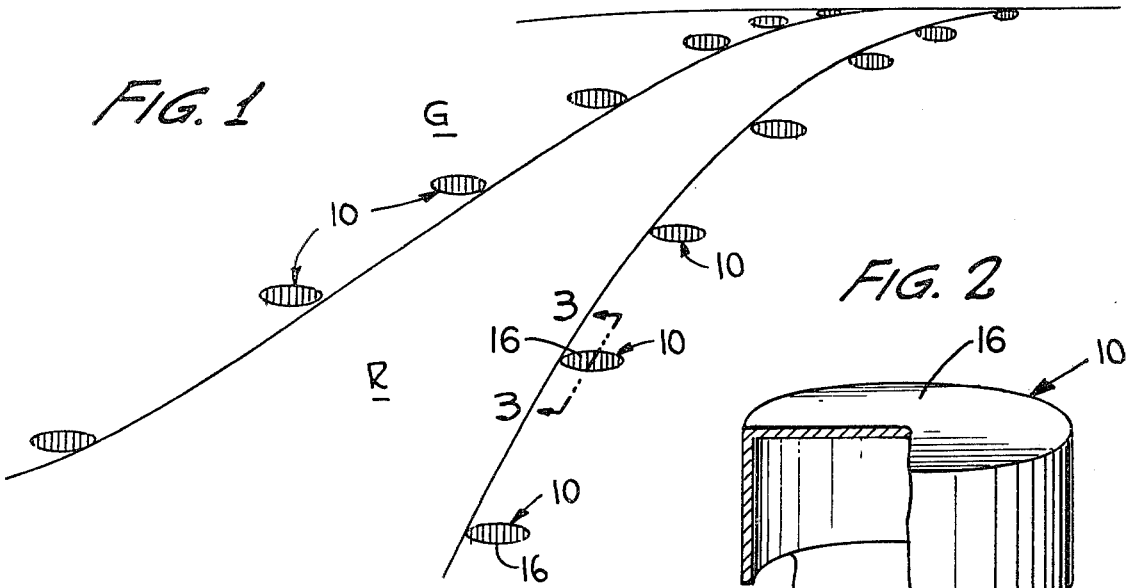
FIG. 1 is a perspective view of a roadway with the shoulders or edges thereof being bounded by ground area markers formed in accordance with the present invention.
Figure 2:
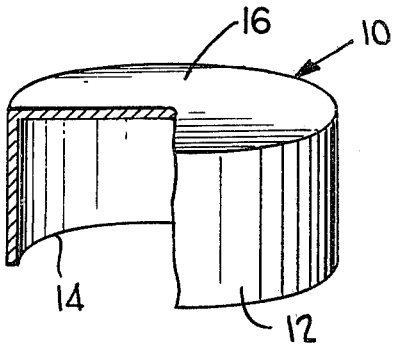
FIG. 2 is a perspective view, partly in section, of a ground area marker constructed in accordance with the present invention.
Figure 3:
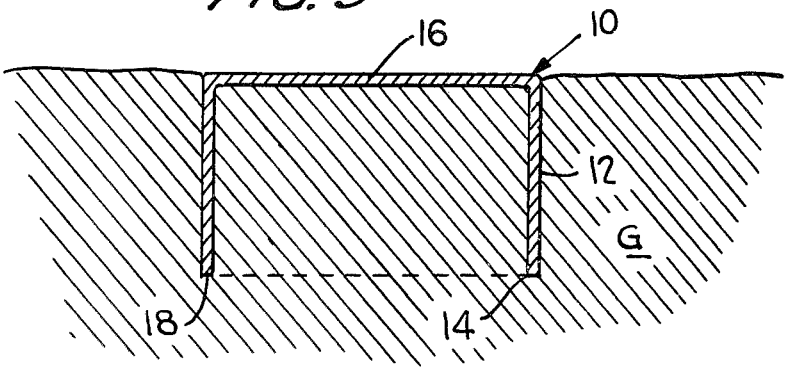
FIG. 3 is a vertical cross-sectional view in situ of a marker and is taken substantially on line 3—3 of FIG. 1.

Referring now more particularly to the accompanying drawings, and initially to FIGS. 1-3 and 5, the ground area marker 10, as shown in detail in FIGS. 2 and 3, is composed of a hollow cylindrical rigid body 12, which has a lower open end 14 and an integral closed upper end or top wall 16. The marker body 12 and the upper end or top wall 16 are formed in one piece from a suitable sturdy but inexpensive material such as durable plastic, metal or the like. The marker is positioned in the ground G, as shown in FIG. 3, by forcing the lower edge 18 of the body 12 at the lower open end 14 down into the ground G so that the body 12 is forced into the ground until the integral upper end or top wall 16 is substantially coplanar with the surface of the ground, as shown in FIG. 3.

Figure 5:
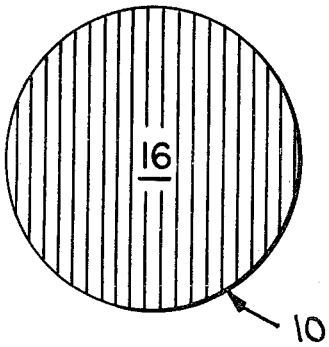
FIG. 5 is a top plan view of the marker and showing the upper surface of the closed upper end colored so as to be distinctive in relation to its ground and highway surroundings of FIG. 1.

The top wall 16 is colored, as shown in FIG. 5, so as to be distinctive in relation to its surroundings, such as the highway R and the ground G of FIG. 1 wherein the marker 10 is shown in use alongside the edge of the highway R for marking off the shoulders of the highway R. The coloring can be effected in any desired manner. And the surface can be coated with a reflective material or substance or covered with such material or substance.

The marker 10 can be used in relation to any ground area, such as a lawn area marker of a general nature, or, in particular, a cemetery, for marking off certain lawn areas, or can be used in any other ground environment for marking purposes. The marker can be easily pressed into the ground under normal foot pressure. It is pressed into the ground until the upper end or top wall 16 is substantially planar with the surface of the ground, as shown in FIG. 3. In such position, as shown environmentally in FIG. 1, the colored reflective upper surface of the closed end or top wall 16 will easily delimit the boundaries of the highway H in relation to the surrounding ground G. The marker can circumscribe virtually in this fashion any other particular ground area.

Figure 4:
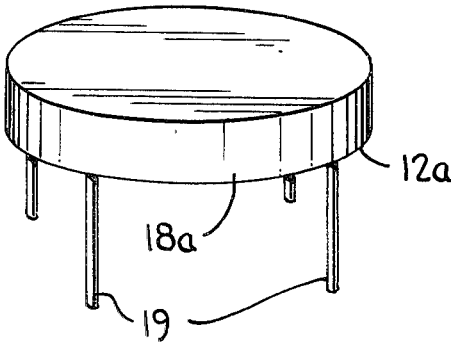
FIG. 4 is a perspective view of a modified form of construction of the marker.

In FIG. 4 the body 12*a* is shorter than the body portion 12 of the embodiment of FIG. 2, and depending from the lower edge 18*a* of the body portion are a number of prongs or legs 19 which are provided to make it easier to force the marker into the ground.

Figure 6:
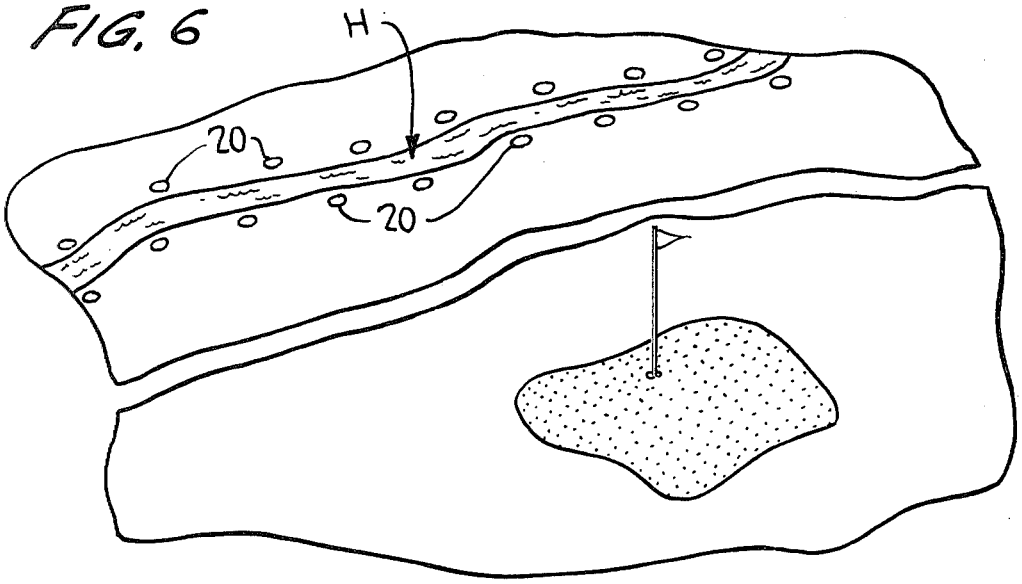
FIG. 6 is a perspective view of a hole of a golf course and illustrates the use of the ground marker of the present invention in connection with the golf course and, in particular, for marking off a hazard on the fairway of the course.
Figure 7:
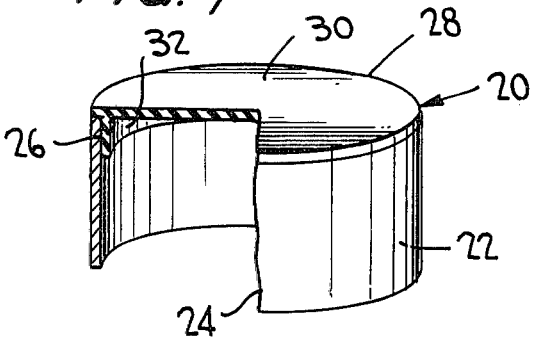
FIG. 7 is a perspective view, partly in section, of the marker embodiment of FIG. 6 for use on a golf course.
Figure 8:
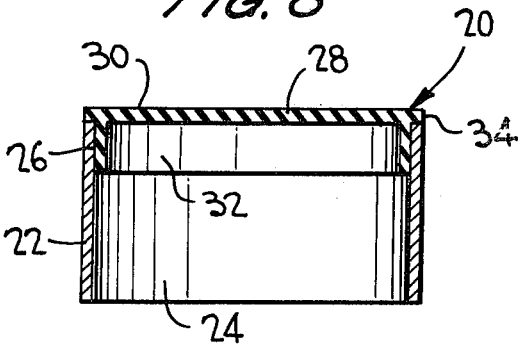
FIG. 8 is a vertical cross-sectional view of the golf course marker of FIG. 6.

In the embodiment of FIGS. 6–10, the marker 20 is depicted for use in a golf course environment, as shown in FIG. 6, with the markers 20 being used to lay out hazards, such as the creek H shown in FIG. 6, or similar areas that may be present along a golf course. In the instance of the marker 20, the same includes a cylindrical body portion 22 which has a lower open end 24 and an upper open end 26. The upper open end 26 is closed off by an inserted top wall 28 which is formed of elastomeric material, such as plastic or the like material, and which has a flat portion 30 from which a cylindrical skirt portion 32 depends with the skirt portion being disposed inwardly of the peripheral edge 34 of the flat portion 30 and depending therefrom. The skirt portion is of a cross-sectional size and diameter to fit snugly within the open upper end 26 of the body portion 22, as shown in FIG. 8, with the peripheral edge 34 of the flat portion 30 resting securely on the upper edge of the body 22 at the open end 26.

The top wall 28 closes off the upper end of the body portion 22 and serves as a top wall or closed upper end therefor. The edge 34 of the flat portion 30 is of a diameter and size to rest on the upper end 26 without extending radially beyond the body portion and with the skirt portion 32 fitted tightly within the upper end 26 of the body portion. Suitable adhesive, such as epoxy, is employed to securely fix the skirt portion 32 within the body portion and to secure the edge 34 of the flat portion 30 on the edge of the upper end 26.

In placing the marker 20 in place in the ground, pressure can be exerted on the edge 34 and thus, to the upper end 26 of the body portion 22 to accomplish depression of the lower end 24 into the ground without damaging the resilient top wall 28 or its attachment to the upper end of the body portion.

Figure 9:
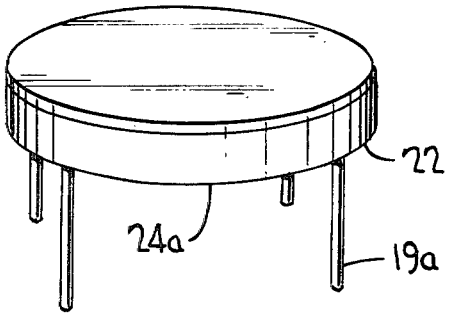
FIG. 9 is a perspective view of a modified form of the golf course marker of FIG. 8.
Figure 10:
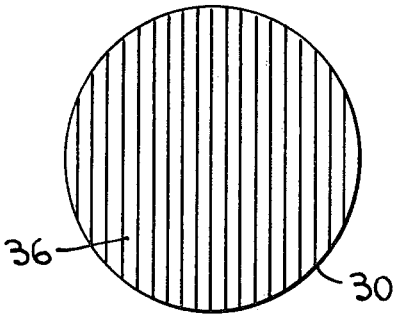
FIG. 10 is a top plan view showing the colored or reflective surface of the closed upper end of the marker of FIGS. 8 and 9.

As shown in FIG. 9, the body portion 22 can be shortened and the lower end 24*a* provided with prongs or legs 19*a* in the same fashion and manner as the body portion 12*a* of FIG. 3.

The upper face or surface of the top wall 28 is suitably colored, as at 36, or otherwise covered or coated with a suitable color or reflective substance so that it stands out in striking contrast to the surrounding green grass of the fairway.

The ground area markers when embedded in the ground cannot be accidentally dislodged nor can they be easily mischievously removed and relocated or stolen. Further, the construction of the marker will afford considerable savings, either in its general use or in its use on a golf course, since the ground marker can be passed over with a lawn mower, snow plow or scraper or other ground surface treating device without damage to the marker. Thus, the markers do not have to be removed from the ground before treating in any manner the ground surface area around the markers.

It can be understood, from the foregoing description taken in conjunction with the drawings, that a simple and sturdy ground area marker is provided for a multiple of uses, each of which can be easily and quickly carried out.

Of course, the description and drawings are merely of an exemplary nature and the invention is only limited by the scope of the appended claims.

What is claimed is:

1. A ground area marker specifically adapted for marking areas of a golf course comprising:

(a) a hollow rigid body portion having opposing upper and lower ends with the lower end being open and being adapted to be inserted under pressure on the upper end into the ground so that the body portion is embedded up to its upper end into the ground; and, (b) means operatively attached to said open upper end for closing off the open upper end defining a ground level top wall for the body portion and being unsupported in the central portion of said open upper end, said means being constructed of an extremely flexible resilient plastic material so that a golf ball in striking the top wall would not unduly bounce but rather would react in the same fashion as when striking the surrounding ground.

2. The ground area marker of claim 1, wherein the upper end is open and is closed off by said means which is constituted by a elastomeric flat member overlyingly affixed to the upper end of the body portion.

3. The ground area marker of claim 1, wherein said means includes an integral top wall having an outer face provided with means to contrast it visually from the surrounding ground area in which it may be placed.

4. The ground area marker of claim 1, wherein said means includes a elastomeric closure member fixed over the upper end to close the same off.

5. The ground area marker of claim 4, wherein said closure member has an outer face provided with means to contrast it visually from the surrounding ground area in which it may be placed.

6. The ground area marker of claim 1, wherein said body portion is cylindrical.

* * * * *